US008105025B2

(12) United States Patent
Albrecht et al.

(10) Patent No.: US 8,105,025 B2
(45) Date of Patent: Jan. 31, 2012

(54) COLLECTING CHAMBER AND PRODUCTION PROCESS

(75) Inventors: Heinrich Albrecht, Krefeld (DE); Michael Jeske, Hünxe (DE); Werner Jonen, Duisburg (DE); Daniel Wentzel, Duisburg (DE); Jan Weule, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/994,457

(22) PCT Filed: May 8, 2009

(86) PCT No.: PCT/EP2009/003299

§ 371 (c)(1),
(2), (4) Date: Mar. 17, 2011

(87) PCT Pub. No.: WO2009/149798

PCT Pub. Date: Dec. 17, 2009

(65) Prior Publication Data

US 2011/0158796 A1 Jun. 30, 2011

(30) Foreign Application Priority Data

May 27, 2008 (DE) ..... 10 2008 025 249
Apr. 23, 2009 (EP) ..... PCT/EP2009/054869

(51) Int. Cl.
*F04D 29/42* (2006.01)
*F04D 29/44* (2006.01)

(52) U.S. Cl. ..... 415/196; 415/204; 415/206; 415/211.1; 415/224.5; 415/226; 409/132; 409/166; 409/199

(58) Field of Classification Search .... 415/169.1–169.4, 415/196, 197, 204, 206, 211.1, 224.5, 226, 415/912; 409/131, 132, 165, 166, 199
See application file for complete search history.

(56) References Cited

U.S. PATENT DOCUMENTS

| | | | | |
|---|---|---|---|---|
| 2,224,615 | A * | 12/1940 | Stratton | 415/204 |
| 3,489,340 | A * | 1/1970 | Holzhausen | 415/196 |
| 3,863,525 | A * | 2/1975 | Cale | 409/131 |
| 4,028,992 | A * | 6/1977 | Kuehnle | 409/132 |
| 4,691,423 | A * | 9/1987 | Willyard et al. | 415/206 |
| 5,076,758 | A * | 12/1991 | Palgrave | 415/214.1 |
| 5,779,406 | A * | 7/1998 | Astor | 409/132 |
| 6,052,897 | A * | 4/2000 | Greber | 29/889.2 |
| 6,193,463 | B1 | 2/2001 | Adeff | |
| 7,179,051 | B2 * | 2/2007 | Williams et al. | 415/204 |
| 7,374,398 | B2 * | 5/2008 | Marchese et al. | 415/189 |
| 2002/0114693 | A1 * | 8/2002 | Bartholoma et al. | 415/204 |
| 2005/0069427 | A1 * | 3/2005 | Roemuss et al. | 417/407 |
| 2010/0202878 | A1 * | 8/2010 | Wacker et al. | 415/208.1 |

FOREIGN PATENT DOCUMENTS

| | | | |
|---|---|---|---|
| DE | 3040747 | A1 | 5/1981 |
| DE | 3005125 | A1 | 8/1981 |
| DE | 19640647 | A1 | 4/1998 |

(Continued)

*Primary Examiner* — Christopher Verdier

(57) ABSTRACT

A collecting chamber of a flow machine which expands in the direction of circumference, including at least one outer shell part and a contour insert is provided. The contour insert is provided with a groove which extends in the circumferential direction and is preferably configured as a helical spiral. The contour insert, is cut from a whole unit and is delimited at one end in the circumferential direction by a bent edge so that the flow losses are minimized during the passage from the collecting chamber into a subsequent diffuser.

7 Claims, 5 Drawing Sheets

FOREIGN PATENT DOCUMENTS

| | | | | |
|---|---|---|---|---|
| EP | 1394366 | A1 | | 3/2004 |
| EP | 1586745 | A1 | | 10/2005 |
| GB | 2062102 | A | * | 5/1981 |
| WO | WO 2009033549 | A1 | | 3/2009 |

* cited by examiner

COLLECTING CHAMBER AND PRODUCTION PROCESS

CROSS REFERENCE TO RELATED APPLICATIONS

This application is the US National Stage of International Application No. PCT/EP2009/003299, filed May 8, 2009 and claims the benefit thereof. The International Application claims the benefits of German application No. 10 2008 025 249.2 DE filed May 27, 2008 and international application PCT/EP2009/054869 filed Apr. 23, 2009. All of the applications are incorporated by reference herein in their entirety.

FIELD OF INVENTION

The invention relates to a collecting chamber of a turbomachine, which widens in the circumferential direction and extends over at least part of the circumference of a machine axis, which collecting chamber is formed from at least one outer shell part and a contour insert, which contour insert has a groove which is milled from solid, extends in the circumferential direction, is laterally delimited at least on one side and has a groove base, which collecting chamber has a first flow opening, which extends in the circumferential direction and is farmed substantially for axial flows, and at least one second flow opening, which is formed substantially for radial flows, wherein the groove has a first end in the circumferential direction and a second end in the circumferential direction, wherein the second end of the collecting chamber in the circumferential direction issues into the second flow opening.

BACKGROUND OF INVENTION

Circumferential chambers of the above type are generally provided in the region of the inflow or the outflow of turbomachines, for example turbines, expanders or compressors. Whereas the region of the rotating flow guide contours, for example of the rotor blades or of the impeller, is optimized to the greatest possible extent in terms of flow, disproportionately high flow losses still frequently occur in the surrounding regions. In order to counter this, the 90° deflection generally required in the region of an inflow or outflow has already no longer been formed as a simple incoming radial flow into an annular chamber, but instead as a preferably tangential inflow to a collecting chamber tapering in the circumferential direction, this also being referred to as incoming spiral flow or outgoing spiral flow.

The size and the non-rotationally symmetrical shape of the collecting chamber mean that the conditions for chip-forming machining of this component are unfavorable, and therefore this component is generally formed as a cast structure. A structure for material-removing production has nevertheless been provided for those sizes where the solid material is available for such a collecting chamber, since the strong dependence on suppliers for cast parts is a major economic disadvantage. Structures of this type generally have a two-part form so as to avoid undercuts during the chip-forming machining. Accordingly, there is an outer shell part and an inner contour insert, which is inserted into the outer shell part and thereby forms a collecting chamber enclosed by the two components. Said collecting chamber generally has an axial, first flow opening, which extends in the circumferential direction, and a second flow opening, which is designed for radial flows.

In the case of a centrifugal compressor, the compressed gas passes, by way of example, from the impeller into a radially oriented annular chamber and then regularly into the collecting chamber after a 90° deflection. In order to avoid turbulence, said collecting chamber is formed with a cross section which widens along the circumferential direction, such that the maximum cross section is located in the region of a radial outflow or the second flow opening where all of the outflowing or inflowing fluid finally collects to form a throughflow. In virtually all cases, this second flow opening is adjoined by a diffuser which feeds the process gas, for example in the case of the compressor, to a further compressor stage, for intermediate cooling or for another process. At the outlet from the collecting chamber into the diffuser, extremely disadvantageous flow losses occur in the case of the milled structure.

DE 1 291 943 B, FR 1300622 A, DE 3040747 A1, EP 1586745 A1 and DE 19640647 A1 each disclose turbomachines having collecting chambers. DE 3040747 A1 discloses a collecting chamber made of hard white cast iron having a round cross section which widens in the circumferential direction. The cast component is very complex and results in a costly and unfavorable dependence of the machine manufacturer on the supplier of the cast parts.

Proceeding from the embodiment of a collecting chamber defined in the introduction, the invention is based on the object of providing a collecting chamber which, in particular in the region of the second flow opening, has only small flow losses and is nevertheless not a cast structure.

SUMMARY OF INVENTION

According to the invention, the object is achieved by a collecting chamber having those features mentioned in the claims. In addition, the invention achieves the object by means of the process for producing a groove in a contour insert as claimed in the claims. The dependent claims which refer back to each independent claim contain advantageous developments of the invention.

The geometrical expressions radially, axially, circumference and tangentially always refer, unless specified otherwise, to the machine axis.

In the case of the outflow, the bent contour of the edge which closes off the groove in the circumferential direction ensures a more advantageous flow distribution and deflection of the fluid moving in the circumferential direction from the collecting chamber to a radial direction of flow, for example of an adjoining pipe. This applies mutatis mutandis to the case of the inflow.

The edge can expediently be bent in such a manner that it continually adjoins a flow contour of a subsequent component, for example a pipe, to the greatest possible extent. An advantageous development in this context provides for a radial projection of the edge to be round.

In order to minimize the flow losses, it is expedient for the edge to have a concave form.

Small flow losses, in particular depending on the adjoining flow-guiding component, can also bring about an elliptical contour of the edge, or it may be advantageous for at least one projection of the edge to have an elliptical contour.

At the same time, or exclusively, a projection of the edge tangential to the groove base may have a round/elliptical or round form, in order to minimize the flow losses.

Bending of the edge in particular in the region of the center of the groove is particularly expedient for minimizing the flow losses.

Bending of the edge in no way means merely rounding during manufacture which is expressed only in a production radius, but rather targeted introduction of the rounding, preferably by means of a milling cutter.

The flow path may have a particularly advantageous form if at least one axial delimiting contour of the groove which forms the collecting chamber or an edge of the groove which runs in the circumferential direction is in the form of a helix. It is thereby possible to utilize the axial extent of the groove as means for expansion in the circumferential direction, and therefore, despite an increasing volumetric flow, at least no increase in the velocity in the collecting chamber toward the outflow, in the case of a compressor, or vice versa in the case of a turbine or an expander, takes place. The formation of a helix can also be used to form the groove over more than 360° of the circumference and to thereby separate the radial outflow (in the case of a compressor) or inflow from the flow forces of the first flow opening, since this region is arranged axially alongside the narrowest region of the collecting chamber, i.e. overlaps with it as seen in the circumferential direction.

Another possible way to circumferentially widen the cross section of the groove extending in the circumferential direction is to design the groove base of the groove as a spiral.

The design as a helix and the design as a spiral can expediently be combined to form a spiral helix, such that the advantages of the two embodiments are utilized.

It is advantageous for a collecting chamber of the type according to the invention to be produced by the process according to the invention, in which process a milling cutter axis, about which the milling cutter rotates, is displaced from a more radial position to a more tangential position when that end of the groove is reached which has a larger cross section than the other end. The rotating circumference of the milling cutter thereby works with a natural circular shape into the solid material of the contour insert in such a manner that the desired bent edge of the delimitation of the groove is achieved in the circumferential direction. Outstanding results have been obtained with respect to minimizing the flow loss when the milling cutter, when it reaches the second end of the groove, is guided out of the contour insert with a milling cutter axis oriented tangentially to the local groove base.

To further minimize the flow losses, an advantageous development of the invention also provides for there to be no direct connection between the start of the collecting chamber and the outlet from the collecting chamber into a subsequent pressure connection. This connection, which is customary in conventional embodiments of the collecting chamber, ensures asymmetries in the pressure profile which bring about forces on the impeller outlet and thereby subject the rotor shaft to loading in the forms of radial forces, and therefore the radial bearings which bear the shaft are also subjected to higher levels of loading.

So that the angular region of the inlet extending in the circumferential direction into the collecting chamber from the impeller is not unreasonably decreased in size, which would also have negative effects on the symmetry of the pressure distribution at the impeller outlet, it is expedient to form the region of the outlet from the collecting chamber into the subsequent pressure connection to be particularly short in the circumferential direction; this is achieved by a further embodiment according to the invention, which provides that the outlet from the collecting chamber is not formed tangentially but instead deflection takes place in the radial direction. Such an embodiment of the outlet from the collecting chamber in the radial direction into the pressure connection saves a particularly large amount of space in the circumferential direction of the collecting chamber, and therefore a pitch of the helix of the collecting chamber can turn out to be smaller and therefore a smaller demand for axial space also arises. In addition, further advantages are obtained particularly with respect to the strength and the demand for material owing to the radial exit or the radial outlet of the pressure connection from a surrounding housing.

These advantages based on the radial outlet from the collecting chamber, which feature is also extremely expedient on its own, without the other features of the present invention, lead especially with regard to high-pressure applications (outlet pressure between 700 and 1200 bar) to significant advantages. Specifically:

- shielding of the impeller or of the shaft from flow/pressure asymmetries which are fed back from the pressure connection or the inlet region thereof,
- owing to the preferably milled transition from the angular collecting chamber to the round pressure connection outlet cross section, which is already present in the collecting chamber itself, the pressure connection is simplified, and this pressure connection can be produced not only as a cast part but instead now also as a turned part (advantage in terms of cost and delivery time), it also being possible for the weld seam preparation for the pressure connection to be carried out by turning on a lathe.

So that no undesirable nozzle effect occurs at the outlet from the diffuser, an increase in the size of the effective milling cutter diameter is expedient in the manner that the milling cutter, as it is pivoted from the more radial orientation to the more tangential orientation, is guided on a path about a center axis which runs parallel to the milling cutter axis spaced apart therefrom by an eccentricity radius. This can take place in such a manner that the milling cutter axis describes a cylinder with a revolution of the circular motion. Said cylinder may be a straight cylinder. The transitions which are most favorable in terms of flow are established if the eccentricity radius increases as the distance from the second end becomes ever smaller. A continuous increase may be effected in this case, e.g. increasing monotonously depending on the pivoting angle or another parameter which indicates that the distance from the second end is becoming smaller.

BRIEF DESCRIPTION OF THE DRAWINGS

The text which follows describes the invention in more detail on the basis of a specific exemplary embodiment with reference to drawings for elucidation.

DETAILED DESCRIPTION OF INVENTION

Figure 1:
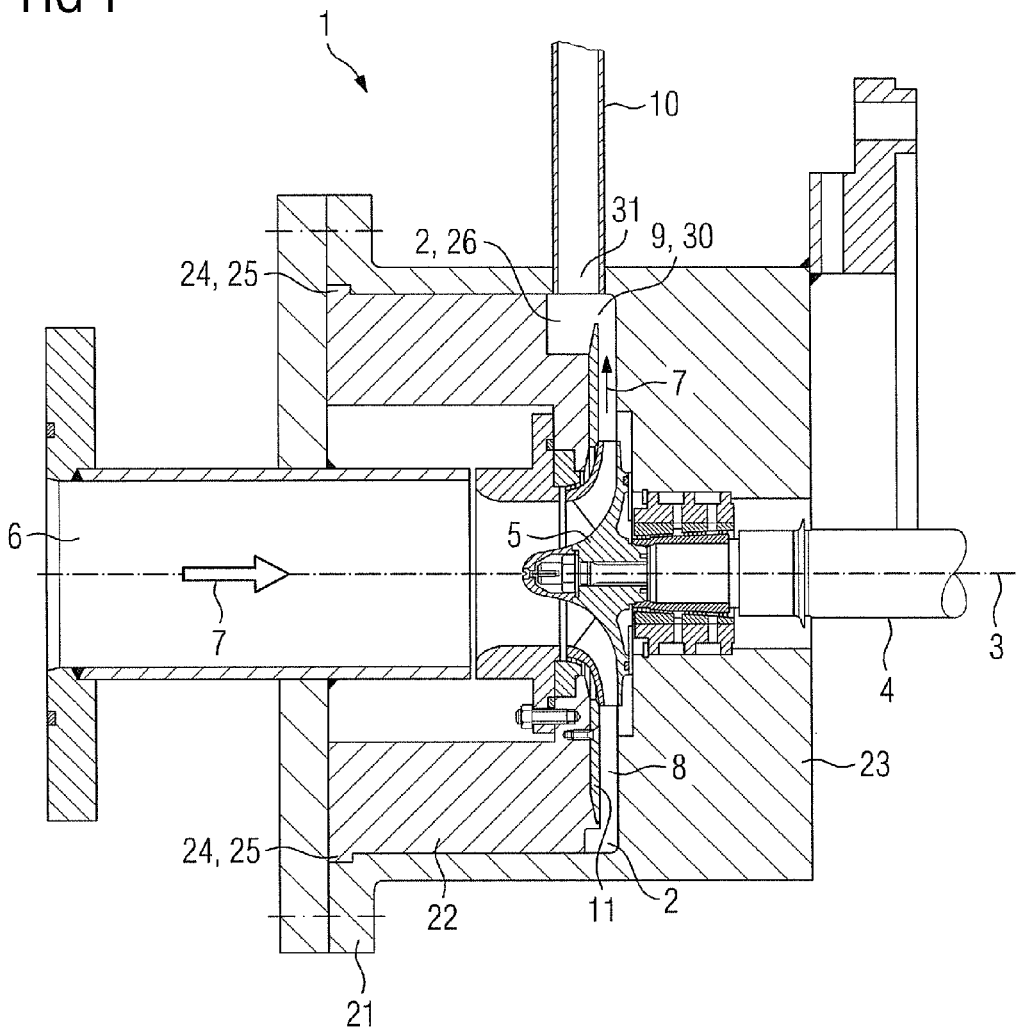
FIG. 1 shows a longitudinal section through part of a single-stage compressor having a collecting chamber according to the invention.

FIG. 1 shows a longitudinal section through part of a compressor 1 having a collecting chamber 2 according to the invention, which extends about a machine axis 3 in the circumferential direction. The compressor 1 has a rotor 4, and the one end of this rotor which is shown has an impeller 5 (compressor stage of a centrifugal compressor) fitted to it, which forms a free end of the shaft of the rotor 4. A fluid 7 flows axially onto the impeller 5 through an inflow 6, and the impeller conveys the compressed fluid radially outward into an annular chamber 8. After a further 90° deflection 9, the fluid 7 flows from the annular chamber 8 into the collecting chamber 2, where it is collected and passes (in a manner not shown specifically) into a further diffuser 10 (shown offset in the circumferential direction).

The collecting chamber 2 is formed by means of an outer shell part 21 and a contour insert 22. The recess in the shell part 21, into which the contour insert 22 is inserted, is a cylindrical bore. The contour insert 22 is fitted into the shell part 21 in such a manner that an enclosed chamber, which forms the annular chamber 8, remains axially at the end of the contour insert 22.

The variant of the contour insert 22 shown in FIG. 1 differs from that shown in FIGS. 2 to 5 in that it is not formed from one piece, but instead is provided at the far end with a diffuser disk 11, which is fastened to the contour insert 22 by means of choke screws.

Figure 2:
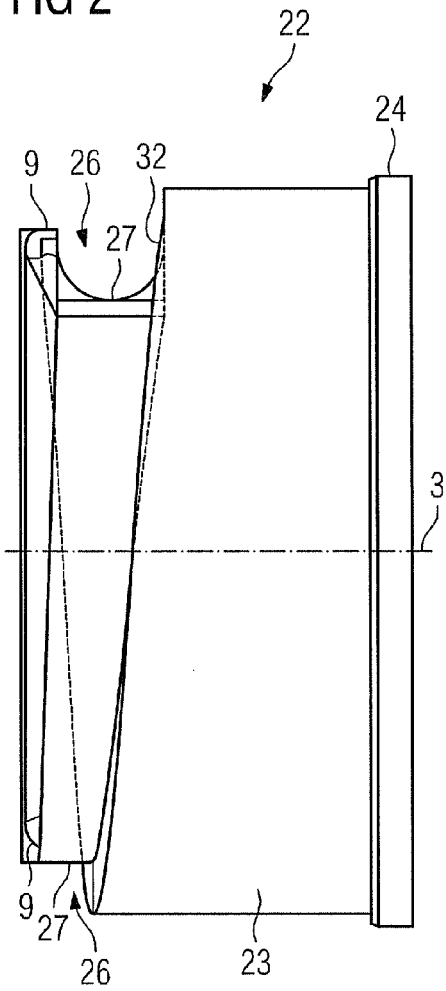
FIG. 2 shows a contour insert according to the invention in a side view.

The contour insert 22 shown in FIG. 2 has a cylindrical base body 23, wherein a step 24 corresponds to a recess 25 on the shell part 21 in such a manner that axial abutment ensures precise axial orientation with a chamber being included for the annular chamber 8. The contour insert 22 is provided with a peripheral groove 26. A groove base 27, which radially inwardly delimits the groove 26, has a spiral form as viewed from the end, i.e. considered in the direction of the machine axis, such that the depth of the groove 26 widens in cross section starting from a first end 28 toward a second end 29.

As shown in FIG. 1, the collecting chamber 2 has a first flow opening 30 which extends in the circumferential direction and into which the fluid 7 flows substantially axially after the 90° deflection 9. A second flow opening 31 for a radial direction of flow is the mouth into the diffuser 10. The second flow opening 31 is located at the second end 29 of the collecting chamber 2 or of the groove 26.

Figure 3:
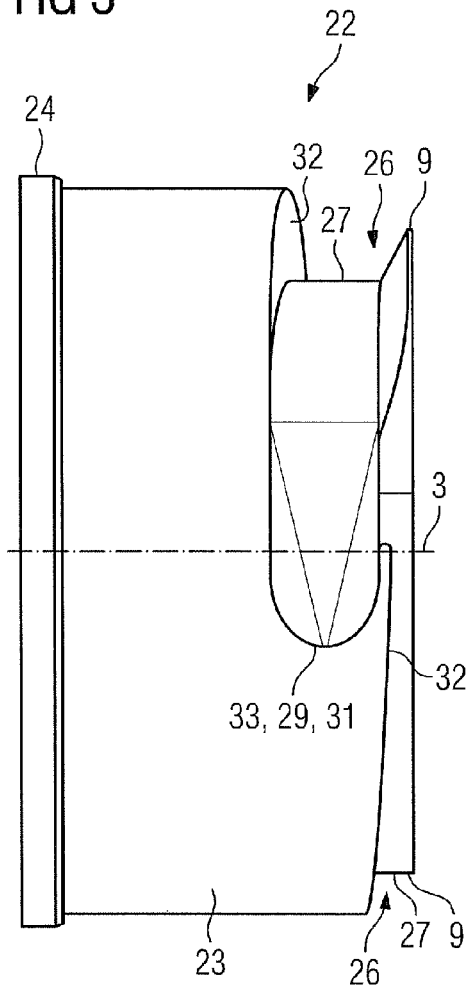
FIG. 3 shows a contour insert according to the invention in a side view and rotated through 90° compared to that shown in FIG. 2.
Figure 4:
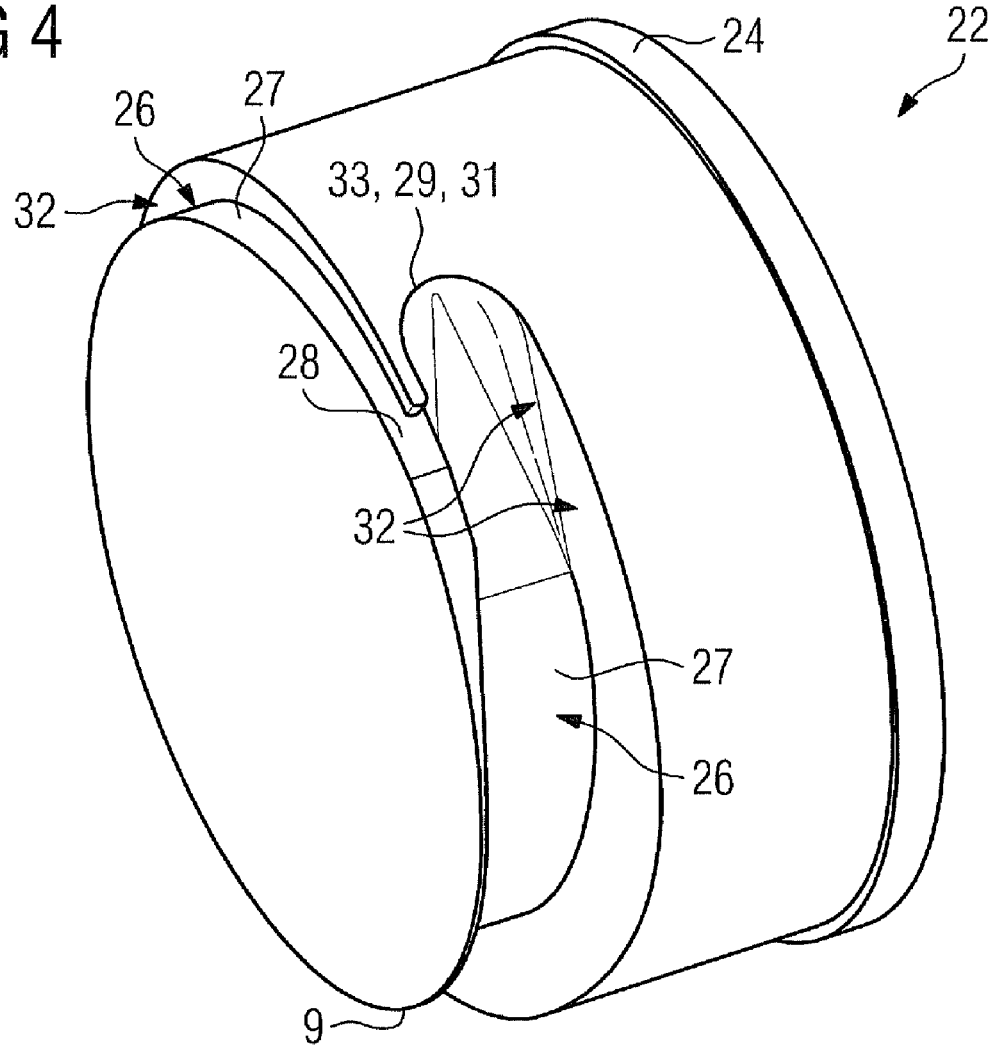
FIG. 4 shows a perspective view of a contour insert according to the invention.

As can also be seen clearly in FIG. 4 and FIG. 3, an axial delimiting contour 32 of the groove 26, which is formed at the start of the contour insert 22 as a step extending in the circumferential direction, is in the form of a helix, and therefore the groove 26 or the groove base 27 forms a helical spiral. The groove base 27 includes a straight form at least in certain regions in the axial direction at least over the first circumferential portion 61. A cross section of the groove 26 is essentially rectangular. As can be seen clearly in FIGS. 3 and 4, the groove 26 is delimited at the second end 29 in the circumferential direction by a bent edge 33. In a radial projection, the bent edge 33 has a round form.

Figure 5:
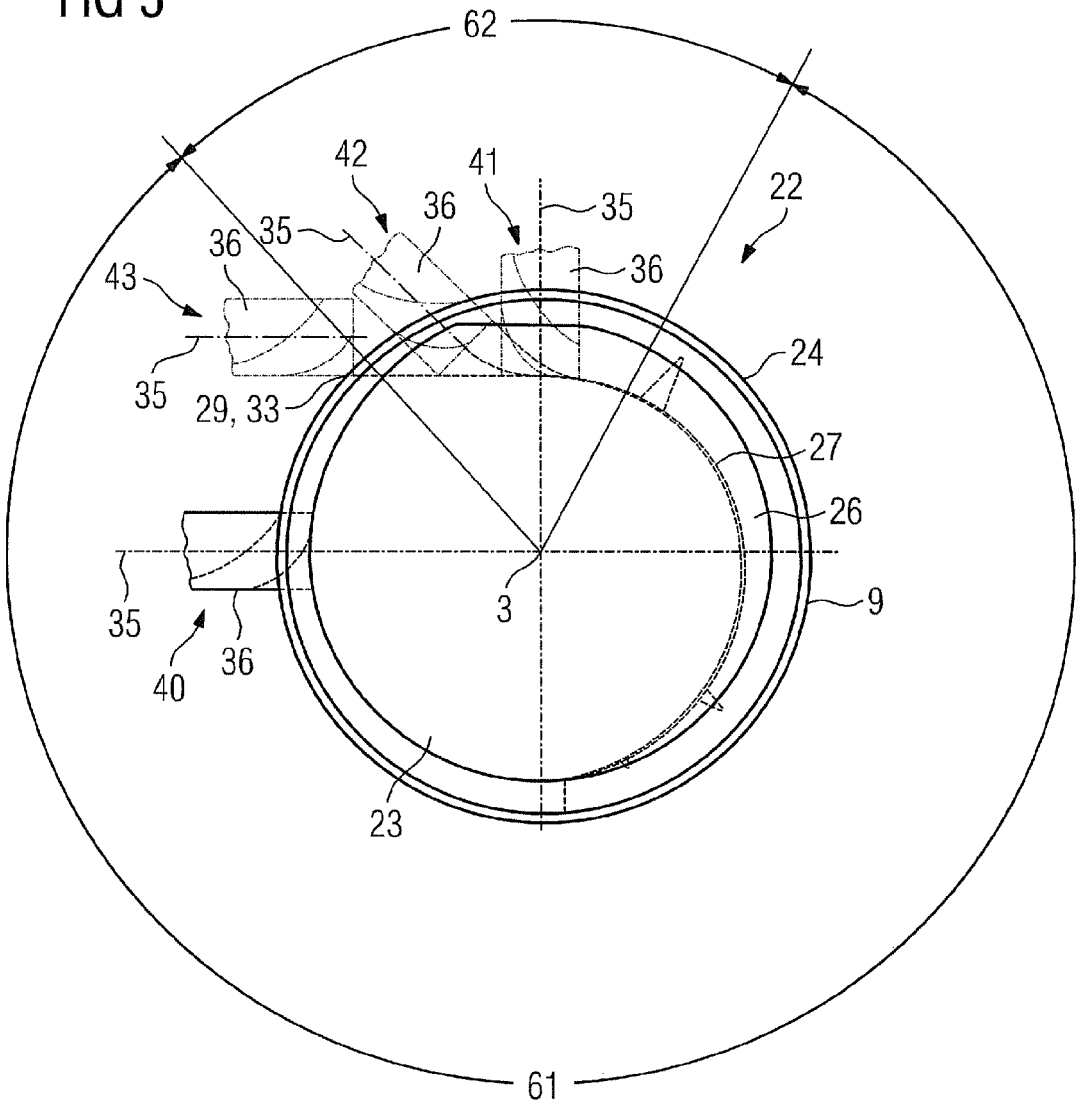
FIG. 5 shows a view from the end of the contour insert according to the invention and the orientation of an end milling cutter during production according to the invention in various steps.

It is clear from FIG. 5 that the groove 26 or the groove base 27 has a first circumferential portion 61, which comprises the first end of the groove 26, and an adjoining, second circumferential portion, which comprises the second end of the groove 26, which groove base 27 has an increase in a curvature which is concave in the axial direction as the distance from the second flow opening 31 becomes smaller.

FIG. 5 also shows how, according to the production process according to the invention, the bent edge 33 is produced by means of a milling cutter 36 which rotates about a milling cutter axis 35. At the start or in the region of the first end of the groove 26 extending in the circumferential direction, the milling cutter 36 plunges into the contour insert 22 with the milling cutter axis 35 oriented radially to the machine axis 3 (e.g. milling cutter position 40). The milling cutter 36 remains in the radial orientation of the milling cutter axis 35, following the curved path of the groove 26 to be produced, as far as a defined circumferential position in the vicinity of the second end 29 of the groove 26. At this point, the milling cutter axis 35 begins to tilt from a more radial orientation to a more tangential orientation, with further relative movement in the circumferential direction between the contour insert 22 and the milling cutter 36, until the milling cutter axis 35 is oriented parallel to the local groove base 27, in which case the milling cutter 36 is no longer lowered into the material to be milled further in the direction of the machine axis 3 of the contour insert 22, but instead is guided out of the workpiece rectilinearly or parallel to the local tangent with the milling cutter axis oriented parallel to said tangent, such that the round milling contour is represented as a bent edge 33 at the second end 29 of the groove 26. In FIG. 5, the milling cutter positions 40, 41, 42, 43 show the change to the milling cutter axis 35 with continued relative movement in the circumferential direction.

Figure 6:
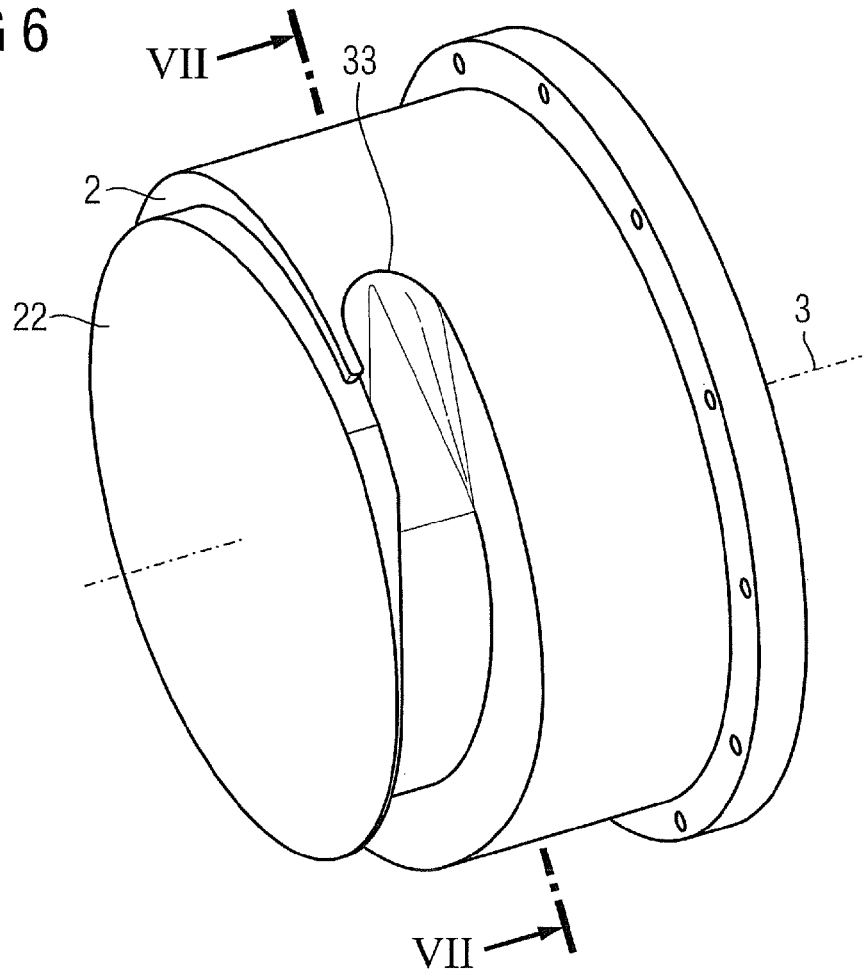
FIG. 6 shows a perspective view of a contour insert according to the invention, in which the collecting chamber has a radial outlet.
Figure 7:
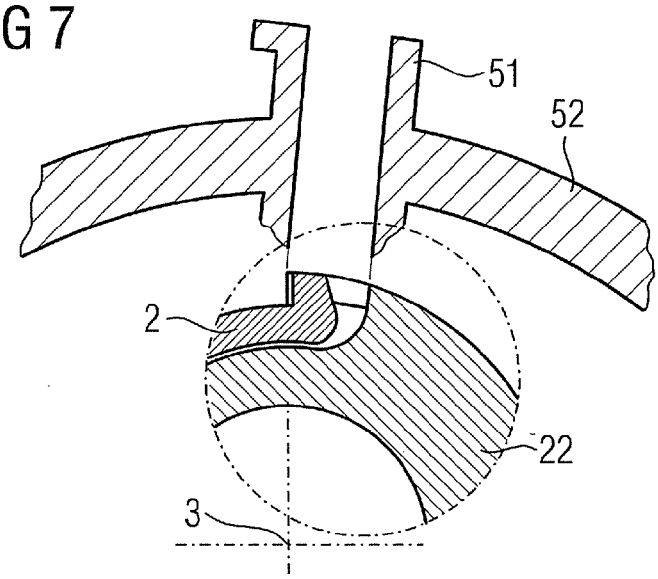
FIG. 7 shows a sectional view, as per section VII in FIG. 6, of a detail of the contour insert in the region of the radial outlet.

FIG. 6 shows a perspective view of a particularly advantageous embodiment of the contour insert 22. With respect to its radially inwardly pointing delimiting contour, the collecting chamber 2 extending upstream of the outlet 50 describes a 90° deflection starting upstream in the circumferential direction and ending downstream in the radial direction. In this case, the deflection substantially describes a shape with a constant radius, i.e. a shape of a segment of a circle, at least in a section axially in the center of the collecting chamber 2, as shown in FIG. 7. FIG. 7 shows an outlet connection 51 of a housing 52, through which outlet connection 51 a process fluid leaves the collecting chamber 2 after deflection from the circumferential direction to the radial direction such that a radial outlet from the housing 52 may be provided by a pressure connection without significant further deflection. Compared to the conventional tangential outlet direction, the radial outlet direction of the outlet connection 51 from the housing 52 has various advantages, specifically increased strength, reduced demand for construction space and a higher degree of symmetry of the forces acting on the housing 52.

The invention claimed is:

1. A collecting chamber of a turbomachine, which widens in the circumferential direction and extends over at least part of the circumference of a machine axis, comprising:

an outer shell part; and a contour insert, which includes a groove, milled from a solid unit and extends in the circumferential direction and is laterally delimited on a side and includes a groove base;

a first flow opening, which extends in the circumferential direction and is formed substantially for axial flows; and a second flow opening, which is formed substantially for radial flows, wherein the groove has a first end in the circumferential direction and a second end in the circumferential direction, wherein the second end in the circumferential direction issues into the second flow opening, wherein the groove base includes a first circumferential cm ion, which comprises the first end, and an adjoining, second circumferential portion, which comprises the second end, and wherein the groove base includes an increase in a curvature which is concave in an axial direction as a distance from the second end becomes smaller wherein a cross section of the groove in a first region is essentially rectangular.

2. The collecting chamber as claimed in claim 1, wherein the groove base includes a straight form at least in certain regions in the axial direction at least over the first circumferential portion.

3. The collecting chamber as claimed in claim 2, wherein the groove is delimited at the second end in the circumferential direction by a bent edge, and wherein the bent edge includes an elliptical form.

4. The collecting chamber as claimed in claim 1, wherein an axial delimiting contour of the groove which forms the collecting chamber is in a form of a helix.

5. The collecting chamber as claimed in claim 1, wherein a bent edge of the groove which runs in the circumferential direction is in a form of a helix.

6. The collecting chamber as claimed in claim 1, wherein the groove base of the groove includes a helical form.

7. The collecting chamber as claimed in claim 1, wherein a process fluid flowing through the collecting chamber is deflected from a first direction of flow initially running in the circumferential direction with respect to the machine axis to a second direction of flow running in the radial direction, such that a radial outlet from a housing may be provided by a pressure connection without significant further deflection.

* * * * *

UNITED STATES PATENT AND TRADEMARK OFFICE

CERTIFICATE OF CORRECTION

PATENT NO. : 8,105,025 B2
APPLICATION NO. : 12/994457
DATED : January 31, 2012
INVENTOR(S) : Heinrich Albrecht et al.

It is certified that error appears in the above-identified patent and that said Letters Patent is hereby corrected as shown below:

IN THE CLAIMS:

Col. 6, Claim 1, line 60-61, remove [cm ion] and insert --portion--

Signed and Sealed this
Twenty-sixth Day of February, 2013

Teresa Stanek Rea
*Acting Director of the United States Patent and Trademark Office*